US007621107B2

(12) United States Patent
Vanderheiden et al.

(10) Patent No.: US 7,621,107 B2
(45) Date of Patent: Nov. 24, 2009

(54) WRAPPING CART MACHINE AND METHOD OF WRAPPING

(76) Inventors: Patrick J. Vanderheiden, 410 Mark St., Aurora, NE (US) 68818; Michael A. Herman, 52 Donne Lee La., Ashland, MA (US) 01721

( * ) Notice: Subject to any disclaimer, the term of this patent is extended or adjusted under 35 U.S.C. 154(b) by 27 days.

(21) Appl. No.: 12/006,147

(22) Filed: Dec. 31, 2007

(65) Prior Publication Data

US 2008/0209859 A1 Sep. 4, 2008

Related U.S. Application Data

(60) Provisional application No. 60/878,303, filed on Jan. 2, 2007.

(51) Int. Cl.
*B65B 53/00* (2006.01)

(52) U.S. Cl. ..... 53/441; 53/399; 53/588; 53/587; 53/389.1

(58) Field of Classification Search ..... 53/399, 53/588, 390, 556, 587, 582, 441, 389.1, 389.2
See application file for complete search history.

(56) References Cited

U.S. PATENT DOCUMENTS 1,109,461 A * 9/1914 Price ..... 53/533
4,369,614 A * 1/1983 Tetzner ..... 53/556
4,574,564 A * 3/1986 Pester ..... 53/441
4,691,499 A * 9/1987 Umeda et al. ..... 53/451
4,745,726 A * 5/1988 Rosenthal et al. ..... 53/77
4,756,143 A * 7/1988 Lancaster ..... 53/556
5,005,335 A * 4/1991 Yourgalite et al. ..... 53/399
5,027,584 A * 7/1991 McMahon et al. ..... 53/451
5,033,250 A * 7/1991 Josefek et al. ..... 53/51
5,168,691 A * 12/1992 Errani ..... 53/587
5,561,971 A 10/1996 Sampson
5,564,258 A * 10/1996 Jones et al. ..... 53/399
5,904,802 A * 5/1999 Niedermeyer ..... 156/479
5,941,049 A * 8/1999 Lancaster et al. ..... 53/399
6,254,714 B1 * 7/2001 Niedermeyer ..... 156/256
6,470,657 B2 10/2002 Huson et al.
6,526,734 B1 3/2003 Huson et al.
6,742,322 B2 * 6/2004 Qicang ..... 53/588
7,051,492 B2 5/2006 Huson

* cited by examiner

*Primary Examiner*—Sameh H. Tawfik
(74) *Attorney, Agent, or Firm*—Vincent L. Carney

(57) ABSTRACT

To palletize packages, a wrapping vehicle includes a vertically mounted drive screw having a plurality of ball nuts mounted at wrapping-effective distances from each other on the vertically mounted drive screw. Each ball-nut has a corresponding cantilever mounted to the ball nut to support a roll of wrapping material. A tension adjustment mechanism is mounted to adjust the resistance to motion of each roll of wrapping material and thus the tension on the wrapping material. The ball nuts are each connected to side support guide plates positioned to slide against the sides of mast housing the drive screw wherein said ball nuts are supported against tilting movement.

11 Claims, 10 Drawing Sheets

WRAPPING CART MACHINE AND METHOD OF WRAPPING

RELATED CASES

This application is a continuation in part application of U.S. provisional patent application 60/878,303, filed Jan. 2, 2007, by Patrick J. Vanderheiden and Michael A. Herman. The benefit of provisional patent application 60/878,303 is claimed.

BACKGROUND OF THE INVENTION

This invention relates to wrapping machines and methods of using them.

It is known to mount rolls of wrapping material such as for example stretch wrapping plastic on movable carts such as push carts and to use the movable carts to wrap materials and apparatuses in place. A typical movable wrapping cart is easily maneuverable by hand to permit circling of the object or objects to be wrapped. One end of a roll of wrapping material is fastened to the objects at a starting point and the roll is moved around the objects to wrap them together. Commonly, the objects are positioned together on a pallet and stretch wrap material is wound around them to hold them together in a process referred to at times as palletizing. Three wheeled push carts with a low horizontal support bed with three wheels mounted below the horizontal support bed and a vertical mast extending from the top of the support bed are one form of maneuverable push/pull cart that may be used. Two front wheels provide support for one end of the mast and one or two turnable rear wheels permit easy maneuverability. A roll of wrapping material is mounted to the mast by a movable carriage. Some prior art wrapping push/pull carts are disclosed in U.S. Pat. Nos. 6,526,734 and 7,051,492.

The prior art wrapping carts utilize one roll of wrapping material that is applied to materials or apparatuses that are being wrapped. These prior art wrapping carts have a disadvantage of being slow and at times difficult to use. Moreover, the positioning and adjustment as to tension of the rolls of wrapping material are clumsy and difficult.

SUMMARY OF THE INVENTION

Accordingly, it is an object of the invention to provide a novel wrapping cart.

It is a further object of the invention to provide a novel method of wrapping materials or apparatuses to form palletized materials and apparatuses.

It is a still further object of the invention to provide a fast and economical method of wrapping apparatuses and materials.

It is a still further object of the invention to provide a novel wrapping cart capable of wrapping materials with exceptional speed.

It is a still further object of the invention to provide a novel wrapping method that applies wrapping material from multiple rolls of wrapping material at the same time.

It is a still further object of the invention to provide a novel wrapping apparatus that applies wrapping material from multiple rolls of wrapping material at the same time.

It is a still further object of the invention to provide a novel method and apparatus for controlling the tension applied to stretchable wrapping materials as they are being used.

It is a still further object of the invention to provide a novel method for inserting and removing rolls of wrapping material.

It is a still further object of the invention to provide a multiple roll wrapping apparatus in which individual rolls may be independently removed and have the tension on the wrapping material adjusted.

It is a still further object of the invention to provide wrapping apparatus and a method in which the user may bring the wrapping material to the desired elevation easily and conveniently.

In accordance with the above and further objects of the invention, an electrically controlled drive mechanism on a vehicle such as a push/pull cart positions rolls of wrapping material (wrapping paper or wrapping film) in elevation under the control of a switch on the handle of the vehicle. In the preferred embodiment, the drive mechanism is an electric actuator which can be actuated by the user from his location when using the vehicle. In the preferred embodiment, the vehicle is a push/pull cart with four wheels, two forward wheels being at the front of the push/pull cart and two rear wheels being at the rear of the cart with the two rear wheels being steerable by a handle mounted at the rear of the cart. However, the push/pull cart may also include three wheels, two forward wheels being at the front of the push/pull cart and one rear wheel being at the rear of the cart with the rear wheel being steerable by a handle mounted at the rear of the cart. Multiple rolls of wrapping material are mounted at vertically spaced positions and simultaneously wrapped around objects or apparatuses to be wrapped. This reduces the time in which the wrapping is performed. For example, with two rolls, two wraps may be applied simultaneously to reduce the time of wrapping by as much as twofold. Similarly, three rolls vertically spaced may reduce the time as much as by threefold and reduce the number of times that a particular item must be encircled by the operator.

Individual rolls of wrapping material may be connected to the apparatus at vertically spaced-apart positions with respect to each other and the resistance to rotation of each roll and thus the tension on the wrapping material may be individually adjusted for that particular roll. If one roll runs out before the other, it may be replaced without having to move the other rolls of wrapping material. Tension is easily manually adjusted by mounting the rolls between an upper adjustable member and a lower adjustable member. The distances between the rolls of wrapping material are wrapping effective distances. In this specification, the words "wrapping effective distances" means distances selected to permit rolls of wrapping material having a weight that can be supported by cantilevers that extend from ball nuts, with widths and a spacing provided to accommodate uneven objects to be securely wrapped without the rolls interfering with one another. The width of the wrapping material is the length of the roll.

The wrapping vehicle or machine of this invention has several advantages, such as for example: (1) it is labor saving; (2) it is fast because of the ability to wrap more than one turn of wrapping material in one revolution about the objects being wrapped; (3) it permits easy positioning of the wrapping material in elevation; and (4) it permits effective adjustment of tension on the rolls of wrapping material.

BRIEF DESCRIPTION OF THE DRAWINGS

The above noted and other features of the invention will be better understood from the following detailed description when considered in the light of the accompanied drawings, in which.

DETAILED DESCRIPTION

Figure 1:
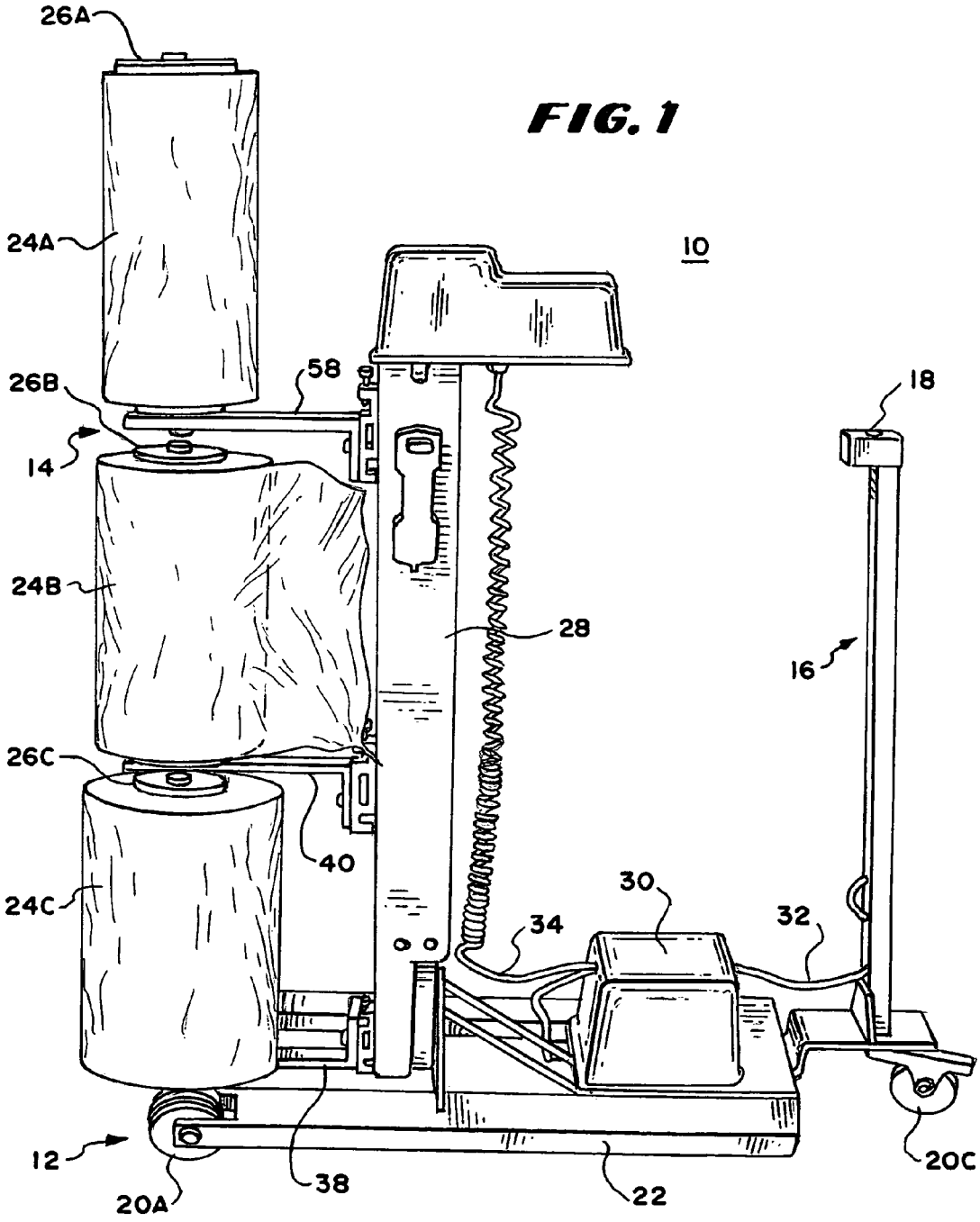
FIG. 1 is a perspective view of a wrapping machine mounted to a push/pull cart in accordance with one embodiment of the invention.

In FIG. 1, there is shown a perspective view of a wrapping vehicle 10 having a vehicle bed 12, a wrapping material assembly 14 and a handle assembly 16. In the embodiment of FIG. 1, the vehicle 10 is a push/pull cart and the handle assembly 16 includes an actuator switch assembly 18 that controls the vertical location of wrapping material mounted to the vehicle. The vehicle bed 12 in FIG. 1 includes three wheels 20A-20C (wheels 20A and 20C being shown in FIG. 1) and a horizontal support 22. Two wheels, 20A and 20B are mounted forward on the bed 12 (only 20A being shown in FIG. 1) and a third wheel 20C is mounted in the back. The third wheel 20C is pivotable to steer the vehicle. While a three-wheeled push/pull cart is shown in FIG. 1, a four-wheeled push/pull cart could be used having two forward wheels at the front of the push/pull cart and two rear wheels (FIG. 8) at the rear of the cart with the two rear wheels being pivotable by the handle mounted at the rear of the cart. Obviously, a pulling cart, a stationary wrapping machine that cooperates with a movable pallet, or a motorized vehicle such as a scooter with rolls of wrapping material attached or any other suitable configuration may also be used.

The wrapping material assembly 14 includes adjustable wrapping material, which in the preferred embodiment is three rolls of wrapping material 24A, 24B and 24C positioned one above the other, a plurality of corresponding tension adjustment mechanisms 26A, 26B and 26C, one for each roll of wrapping material, a mast 28 and a battery 30. The rolls of wrapping material 26A-26C are vertically adjustable as a group and the number of rolls and vertical spacing between the rolls can be changed. The width of the wrapping material is changed by changing the rolls of wrapping paper. The mast 28 includes a drive mechanism that lifts the entire assembly of wrapping material upwardly or lowers it downwardly as called for during the wrapping operation.

The handle assembly 16 controls the angle of the rear wheel 20C in the preferred embodiment but the wrapping vehicle 10 may be steered by other mechanisms that alter the angle of the front wheels or the angle of an intermediate joint between the rear wheels and the front wheels. The actuator switch assembly 18 on top of the handle assembly 16 is connected by an electrical connector 32 to the battery 30 that supplies power through an electrical connector 34 to the drive mechanism. In this specification, the word, "front" means the side of the vehicle that is at the front of the direction in which the vehicle is intended to move and the word "rear" means the side of the vehicle having a handle for pushing the vehicle.

While a movable vehicle is described in connection with FIG. 1, the objects to be wrapped may instead be mounted on a movable member and the wrapping material on a stationery member or both may be movable to create movement between the two and thus a wrapping operation of the wrapping material on the object to be wrapped. Thus, a turntable may mount an object or objects that are to be wrapped and a stationary wrapping assembly may be connected to the objects and the objects turn so that the wrapping material is wrapped around the objects. The elevation of the wrapping material may be controlled by an operator to wrap the entire desired vertical length of an object or objects. Moreover, the wrapping vehicle or wrapping machine 10 may contain a plurality of parallel wrapping material assembles and the rolls of the wrapping material may be at overlapping positions on the different wrapping material assemblies to apply overlapping wraps in a single loop around a pallet.

Figure 2:
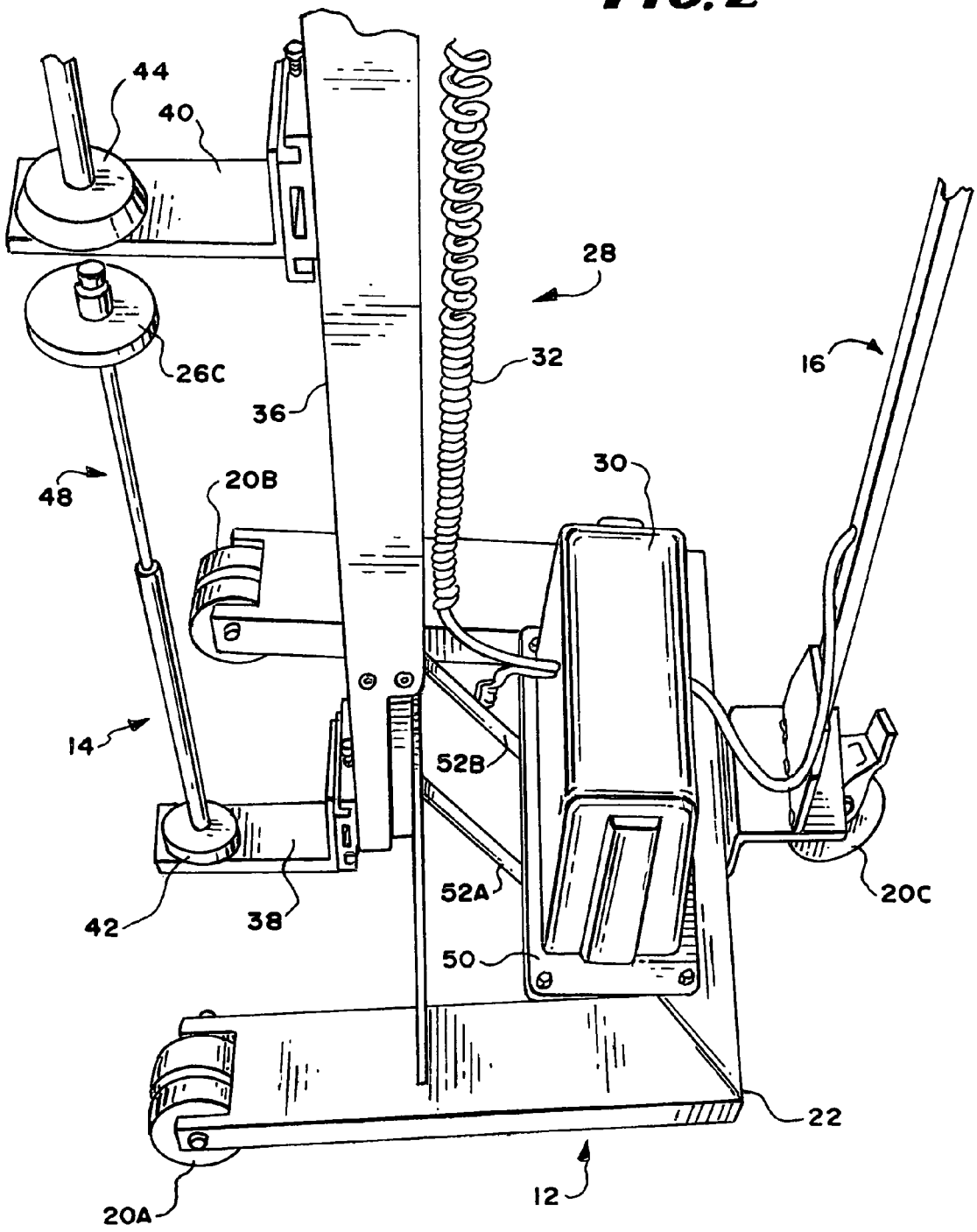
FIG. 2 is a fragmentary perspective view of a lower portion of the wrapping machine of FIG. 1.

In FIG. 2, there is shown a fragmentary perspective view of the vehicle bed 12, the wrapping material assembly 14 and the handle assembly 16. The wheels 20A-20C are shown supporting the horizontal support 22 of the vehicle bed 12 with the battery 30 mounted on a rearward section of the horizontal support 22 and the handle assembly 16 supported by the turnable wheel 20C and connected to the rearmost end of the horizontal support 22. The wrapping material assembly 14 is shown without rolls of wrapping material to make visible a lower vertically-moveable ball-nut driven cantilever 38, a lower wrapping material roll bottom support 42, a lower wrapping material roll tension adjustment mechanism 26C, a middle vertically-moveable ball-nut driven cantilever 40 and a middle wrapping material roll bottom support 44. As shown in this view, a vertical central support post 48 extends through and connects the vertically-moveable ball-nut driven cantilevers 38, 40 and 58 (38 and 40 being shown in FIG. 2) and corresponding wrapping material roll tension adjustment mechanisms 26A-26C (26C for the lower roll 24C (FIG. 1) being shown in FIG. 2) so that each roll fits between a bottom support such as 42 shown in FIG. 2 and a tension adjustment mechanism such as 26C shown in FIG. 2. The tension adjustment mechanisms 26A-26C (FIG. 1) may be tightened toward the bottom supports 42, 44 and 46 (FIG. 1) to adjust the tension in the rolls with the vertical post 48 permitting rotation of the rolls as the wrapping material is removed for application to an object.

The vertical support post 48 is formed in sections with each section extending between a bottom roll support such as lower vertically-moveable ball-nut driven cantilever 38 and lower wrapping material roll support 42 and a tension adjustment mechanism such as tension adjustment mechanisms 26C so that the sections can be disconnected for replacement of a roll if desired. Each of the vertically-moveable ball-nut driven cantilevers such as the lower vertically-movable ball-nut driven cantilever 38 and the middle vertically-movable ball-nut driven cantilever 40 is separately mounted by a roller nut to a drive screw within a mast enclosure 36 to be separately supported and thus permit removal of a roll at any position for replacement with a full roll. The mast 28 is supported by a central section 50 of the support bed 22 by two parallel struts 52A and 52B that connect a forward edge of the central section 50 to two parallel sides of the mast enclosure 36.

Figure 3:
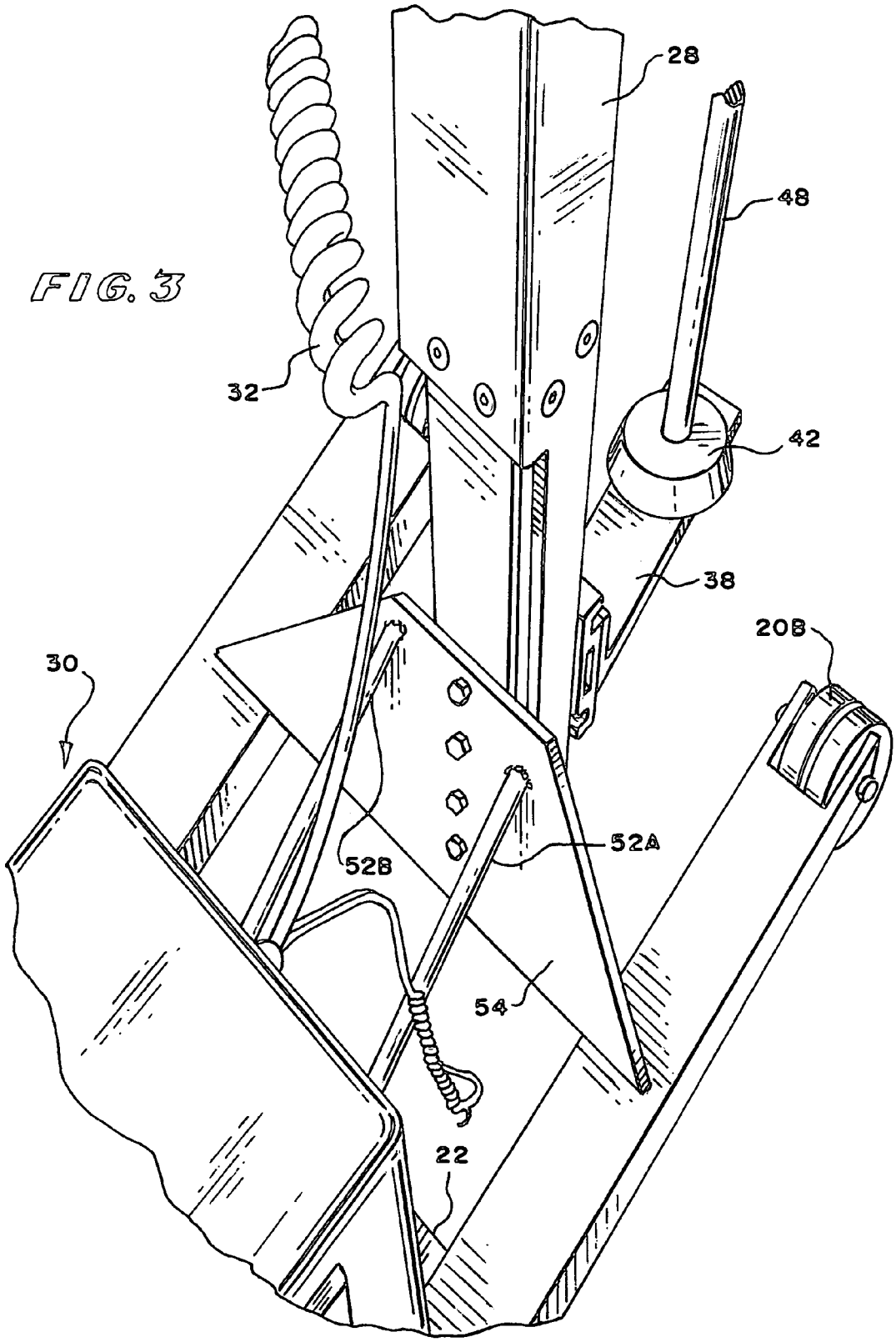
FIG. 3 is a perspective view showing another portion of the lower part of the wrapping machine of FIG. 1.

In FIG. 3, there is shown a fragmentary view of the mast 28 of the wrapping machine 10 supported by the parallel struts 52A and 52B and a mast support plate 54 which are mounted to two extending legs of the horizontal support 22. As shown in this view, the vertical axial central support post 48 extends upwardly forwardly of the mast 28 and includes a plurality of vertically-moveable ball-nut driven cantilevers 38, 40 and 58 (38 being shown in FIG. 3), bottom supports 42, 44 and 46 (42 being shown in FIG. 3) and movable ball-nut driven cantilevers 38, 40 and 58 (38 being shown in FIG. 3).

Figure 4:
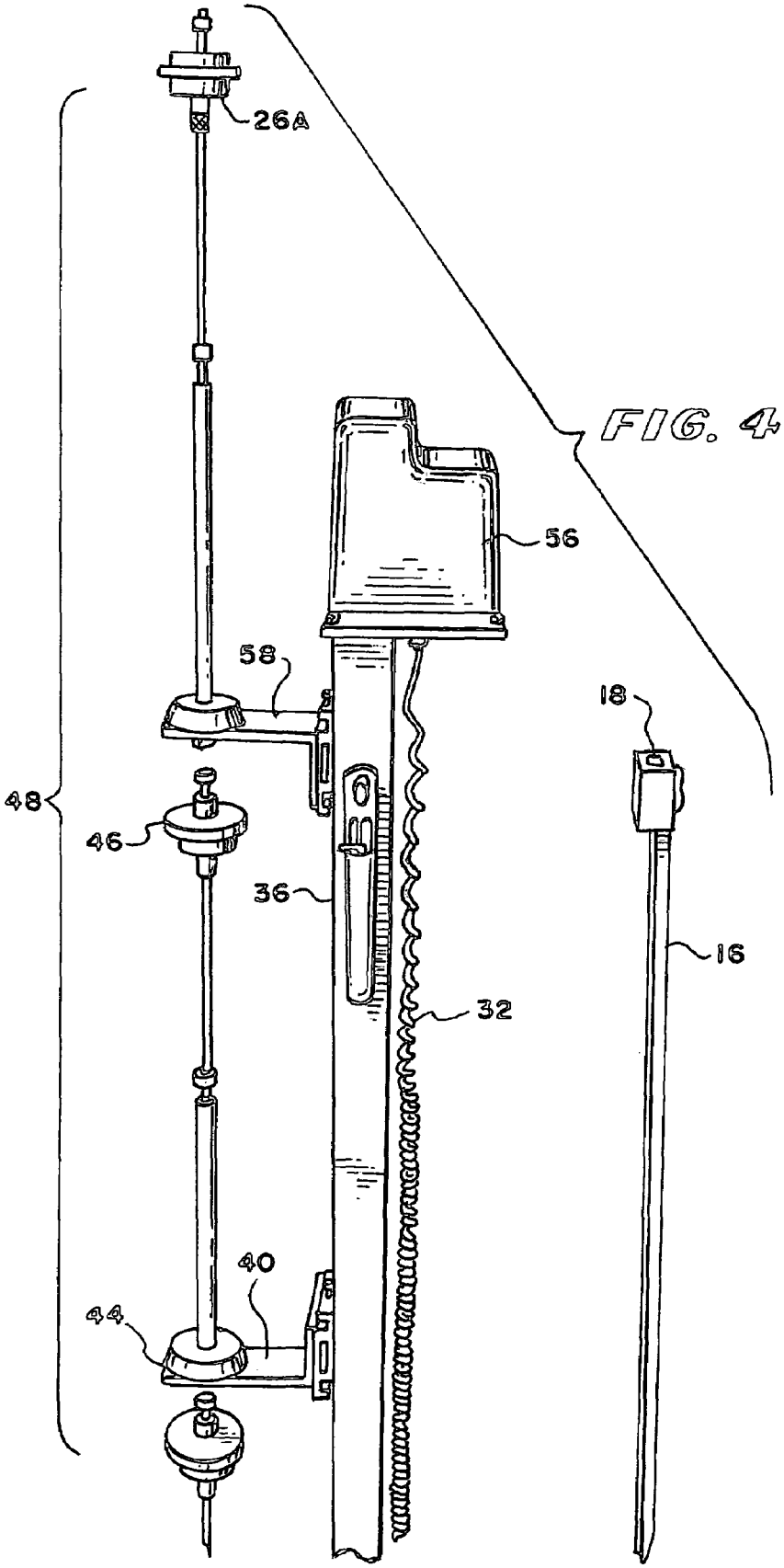
FIG. 4 is a fragmentary simplified perspective view showing the upper portion of the wrapping machine of FIG. 1.

In FIG. 4, there is shown a fragmentary view showing a switch 18 at the top of the handle assembly 16, a motor compartment 56 at the top of the mast enclosure 36 for moving the top vertically-movable ball-nut driven cantilever 58 for the bottom of the wrapping roll 24A (FIG. 1) and the middle movable support 44 for the bottom of the middle wrapping material roll 24B (FIG. 1). The motor 56 rotates a screw lift to move the middle roll bottom support 44 and the upper roll bottom support 46 to adjust the wrapping material to the location on the object being wrapped.

Figure 5:
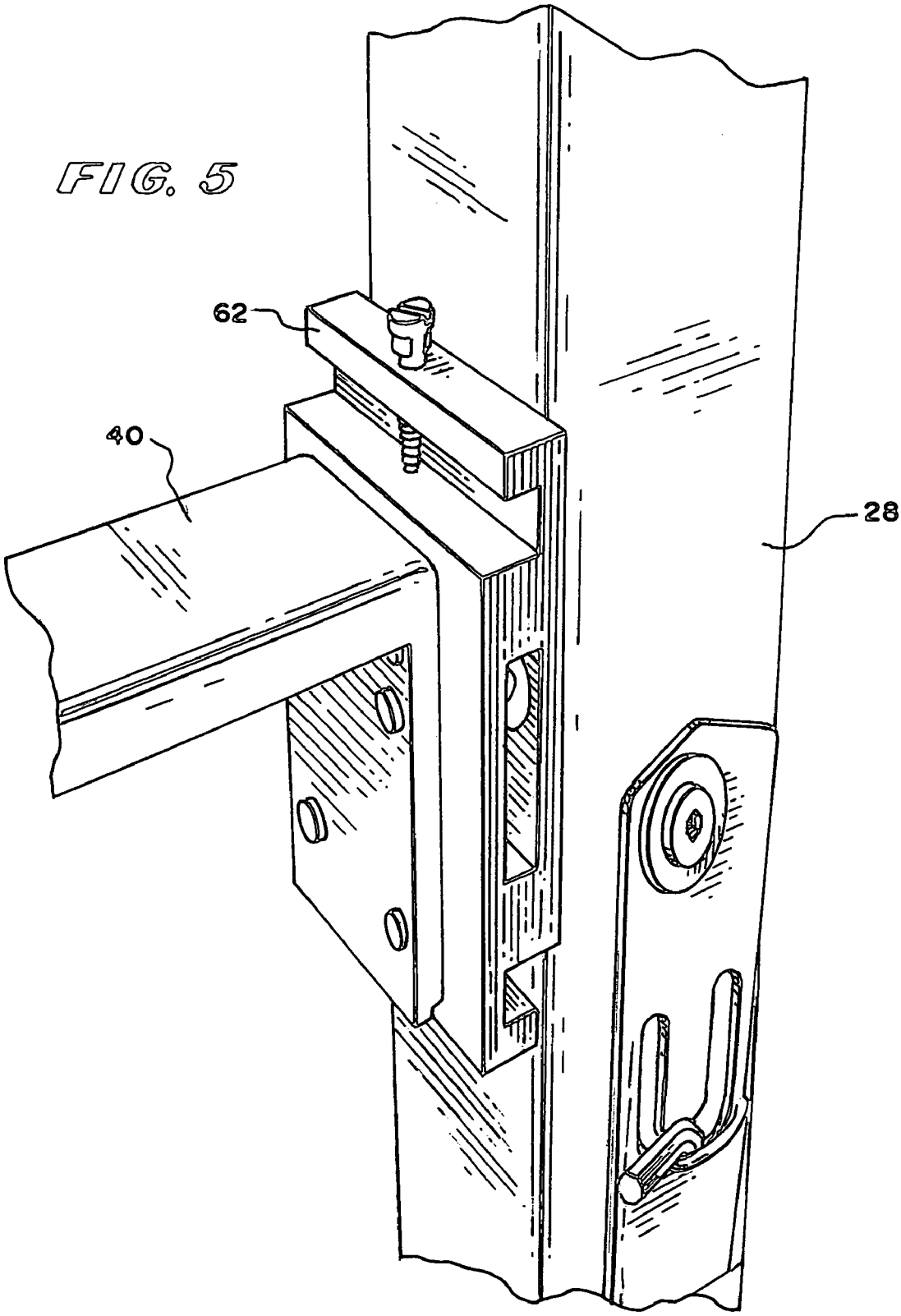
FIG. 5 is a detailed perspective fragmentary view of a movable support member which is part of the embodiment of FIG. 1.
Figure 6:
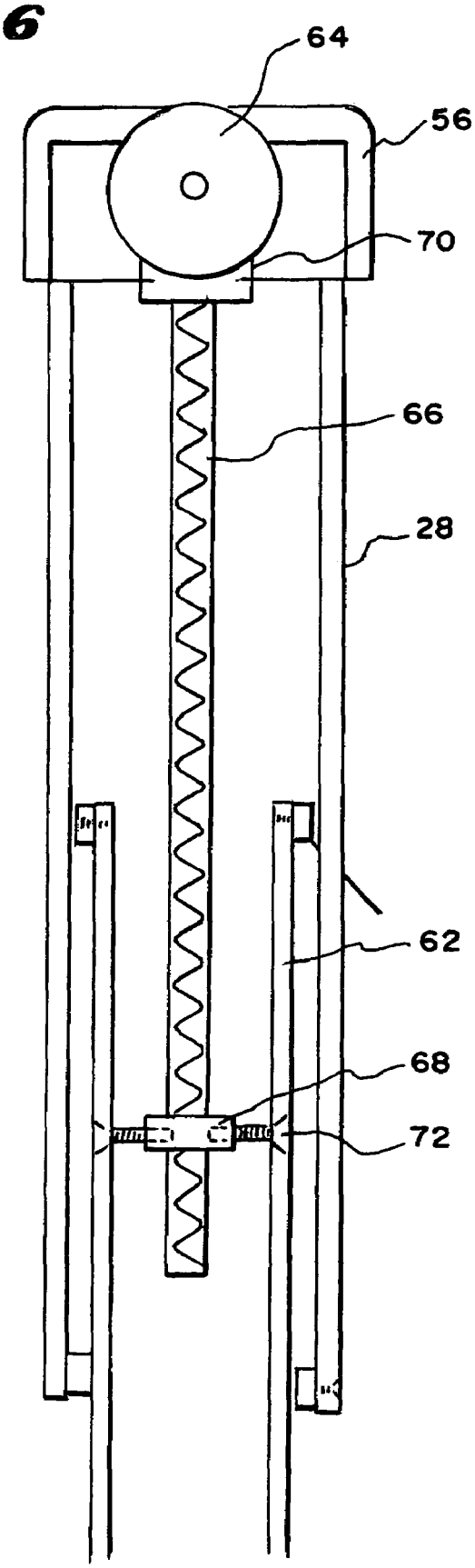
FIG. 6 is a schematic diagram of a drive mechanism in the embodiment of FIG. 1.

In FIG. 5, there is shown a fragmentary perspective view of the mast 28 with a vertically movable ball-nut driven cantilever 40 mounted to a support guide plate 62. The support guide plate 62 fits slideably within a channel of the vertical mast 28 to be movable upwardly and downwardly in response to the drive screw 66 (FIG. 6). As it moves upwardly or downwardly, it carries the wrapping roll vertically-movable ball-nut-driven cantilever 40 with it.

In FIG. 6, there is shown a schematic diagram of the mast 28 which is shaped as a channel to provide side members to support guide plates 62 and having a motor 64 mounted within the motor compartment 56 and adapted to drive the drive screw 66. The drive screw 66 is mounted within a ball nut 68 to move the ball nut 68 upwardly or downwardly depending on the direction of rotation of the motor 64. The ball nut 68 is connected to the support guide plate 62 to move the support guide plate 62 upwardly or downwardly and thus move the wrapping material rolls 24A-24C (FIG. 1) upwardly or downwardly in response to the actuation of the switch 18 (FIG. 4). The motor 64 is a 12 volt DC motor attached to the drive screw 66 through a worm gear case 70. The ball nut 68 is a ⅜ inch diameter standard housing nut held in place to the support guide plate 62 by a bolt 72 to move the support guide plate 62 upwardly and downwardly under the control of the switch 18 (FIG. 4). This unit is an actuator unit model 85152 within an 18 inch stroke and a 20 to 1 reduction. The motor is a 6,000 revolutions per minute motor with an H-D break type B. In the preferred embodiment, the drive screw 66 has three ball nuts mounted to it to drive the three cantilevers 38, 40 and 58 (FIGS. 1, 2 and 4).

Figure 7:
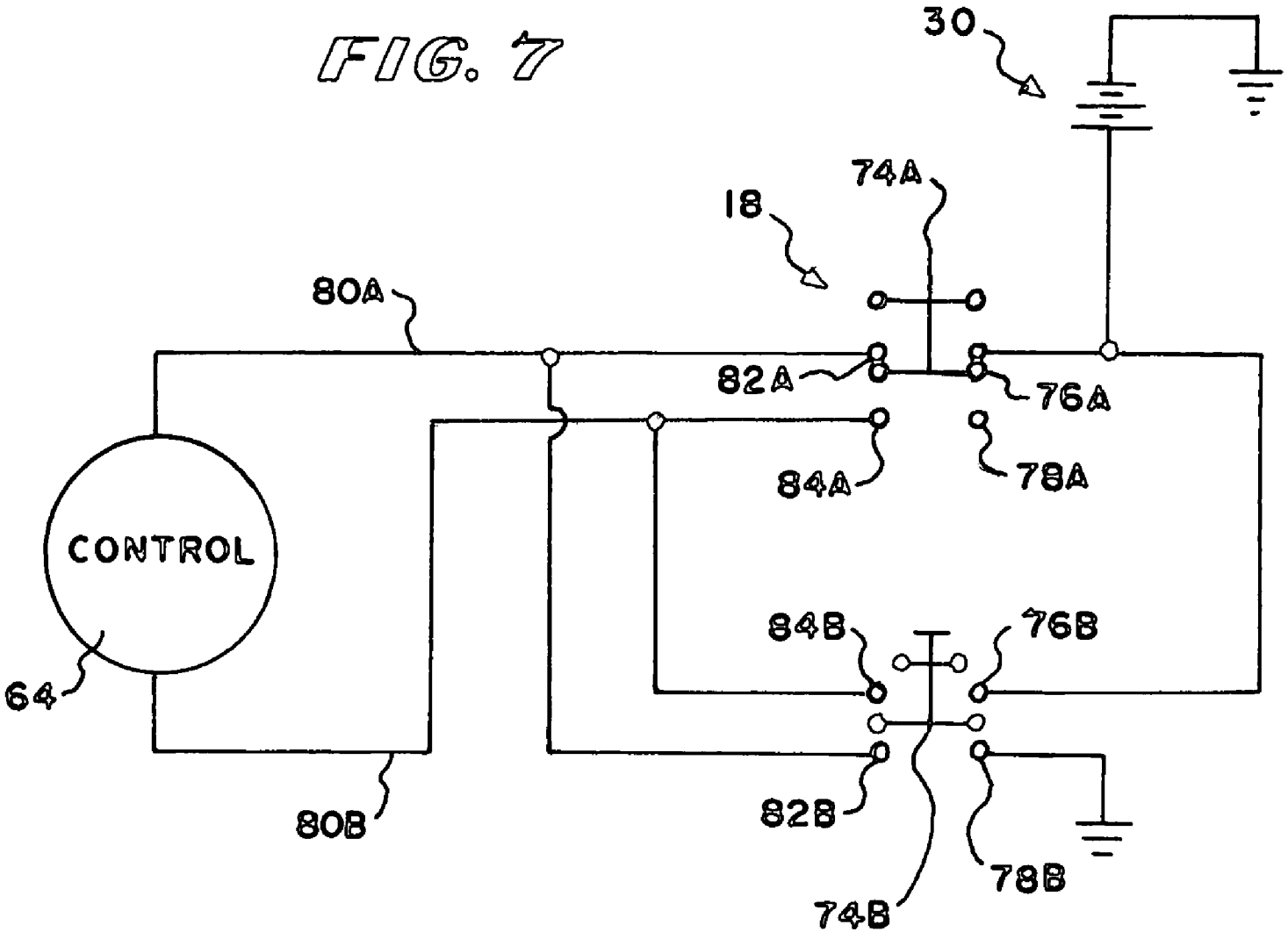
FIG. 7 is a schematic circuit diagram of a circuit used to operate the drive mechanism of FIG. 6.

In FIG. 7, there is shown a schematic circuit diagram showing the switch assembly 18, the DC battery 30 and the motor 64 interconnected so that the switch assembly 18 may raise or lower the rolls of wrapping material 24A-24C (FIG. 1). The switch assembly 18 includes first and second normally open, single throw, double pole push button switches 74A and 74B each having a first contact 76A and 76B respectively electrically connected to the positive terminal of the DC battery 30 and a contact 78A and 78B respectively electrically connected to ground. One terminal of the DC motor 64 is electrically connected through a conductor 80A to a contact 82A of the double pole push button switch 74A and to a contact 82B of the double pole push button switch 74B. With this arrangement, when the double pole, single throw, push button switch 74A is depressed, the contact 82A is connected to the contact 76A to apply positive voltage through the conductor 80A to the motor 64. At the same time, a conductor 80B is electrically connected through a contact 84A to ground through the contact 78A so that the motor 64 rotates in a first direction with a positive potential being applied through one terminal through the conductor 80A with the conductor 80B being grounded.

Similarly, when the push button switch 74B is depressed, the contact 82B is connected to the contact 78B to ground so as to connect the conductor 80A to ground and a contact 84B is connected to the contact 76B to connect the conductor 80B to the source of positive potential from the battery 30 and thus rotate the motor 64 in the opposite direction. With this arrangement, the rolls of wrapping material can be raised or lowered by depressing the appropriate push button switches 74A or 74B of the switch assembly 18 on the handle assembly 16 (FIGS. 1, 2 and 4). The operator by using the handle assembly 16 can in this manner raise or lift the rolls of paper and the vertical location at which the wrapping material is being as the operator moves the vehicle around the object or group of objects being wrapped. Similarly, when the object or group of objects is mounted on a turntable, the operator can easily raise or lower the rolls of wrapping material to adjust the elevation at which the wrapping material is being applied to the object or groups of objects.

Figure 8:
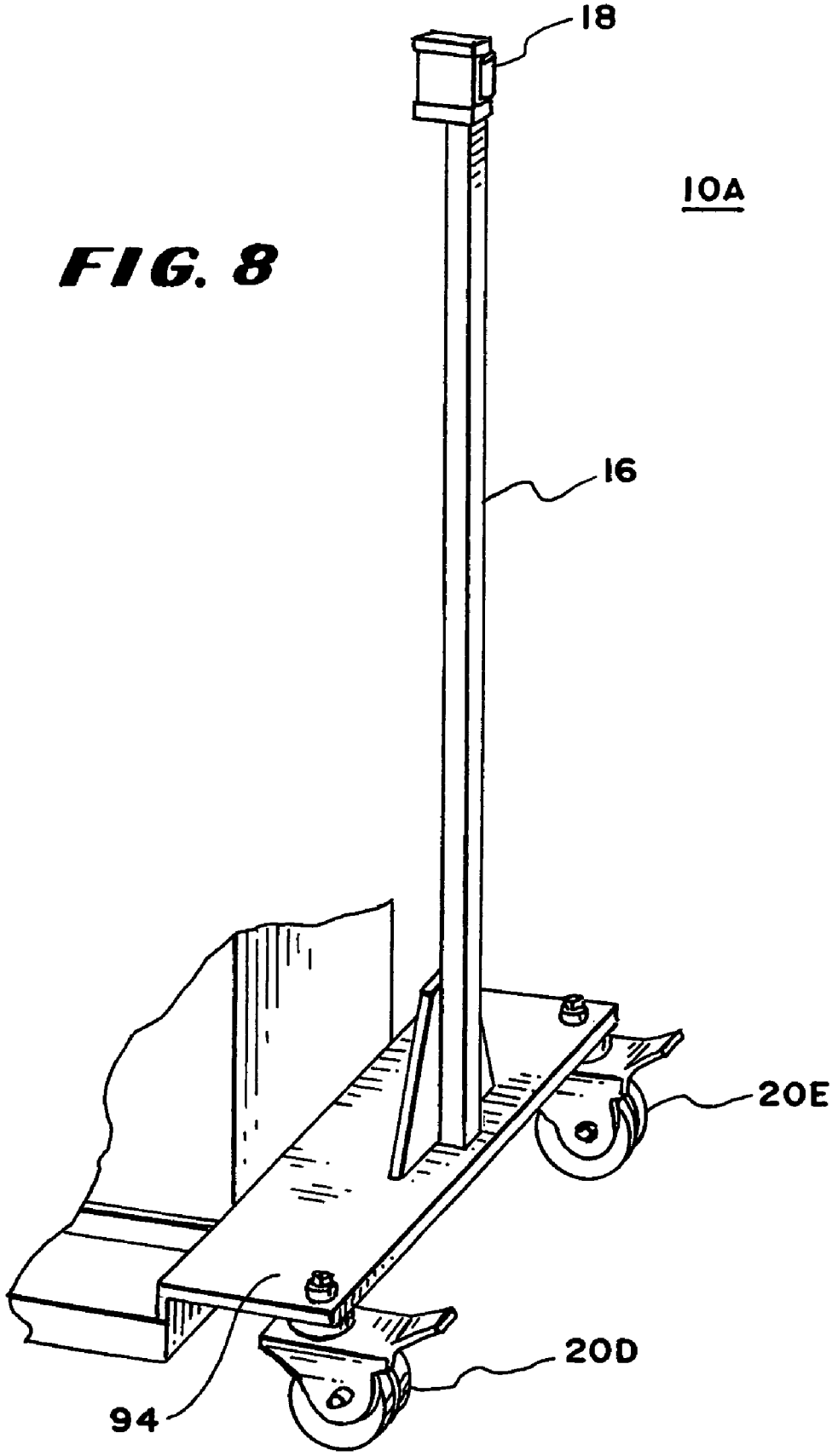
FIG. 8 is a fragmentary perspective view of a portion of another embodiment of the push/pull cart showing the rear wheels and handle of a four wheel push/pull cart.

In FIG. 8, there is shown a perspective view of a rear portion of another embodiment of wrapping vehicle 10A having four wheels two of which are rear steerable wheels 20D and 20E (the two front wheels not being shown in FIG. 8). In FIG. 8, the parts of the wrapping machine 10A that are the same as the corresponding parts in the wrapping machine 10 of FIG. 1 have the same reference numerals as in FIG. 1. In the embodiment 10A, the two rear wheels 20D and 20E, are mounted to an elongated support 94 and are each turnable to permit steering of the vehicle from the handle.

Figure 9:
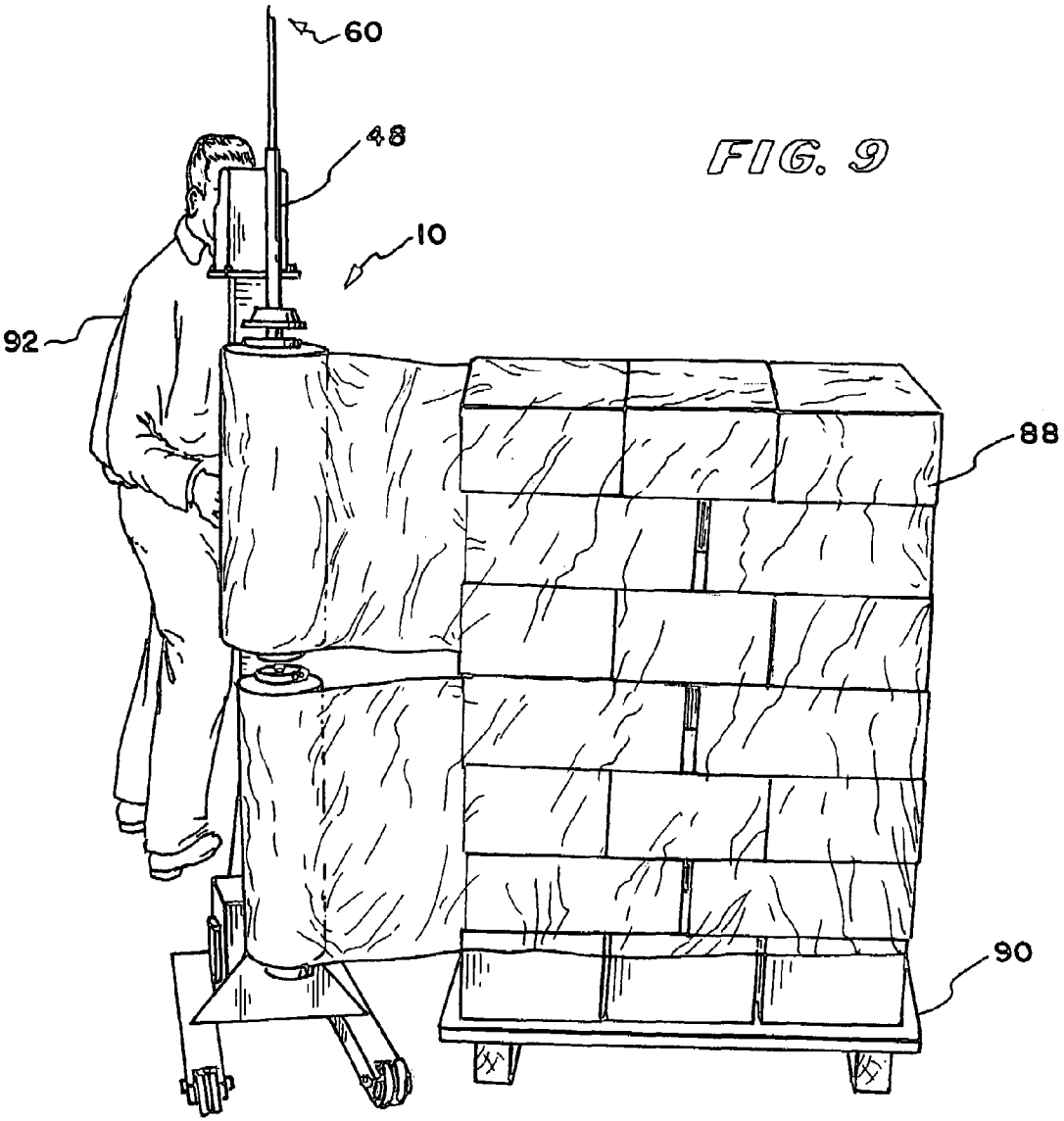
FIG. 9 is a perspective view showing the use of the wrapping machine of FIG. 1.

In FIG. 9, there is shown an operator 92 holding the handle of a push/pull cart vehicle 10 with two rolls of wrapping material on it and moving the wrapping material around objects 88 on a pallet 90 to palletize them. With his hand on the handle 16 (handle 16 not shown in FIG. 9) the operator 92 may actuate the switch assembly 18 (FIGS. 1 and 7) to raise or lower the rolls of wrapping material to position them correctly on the objects 88 as the operator 92 pushes the cart around the objects 88 to palletize them.

Figure 10:
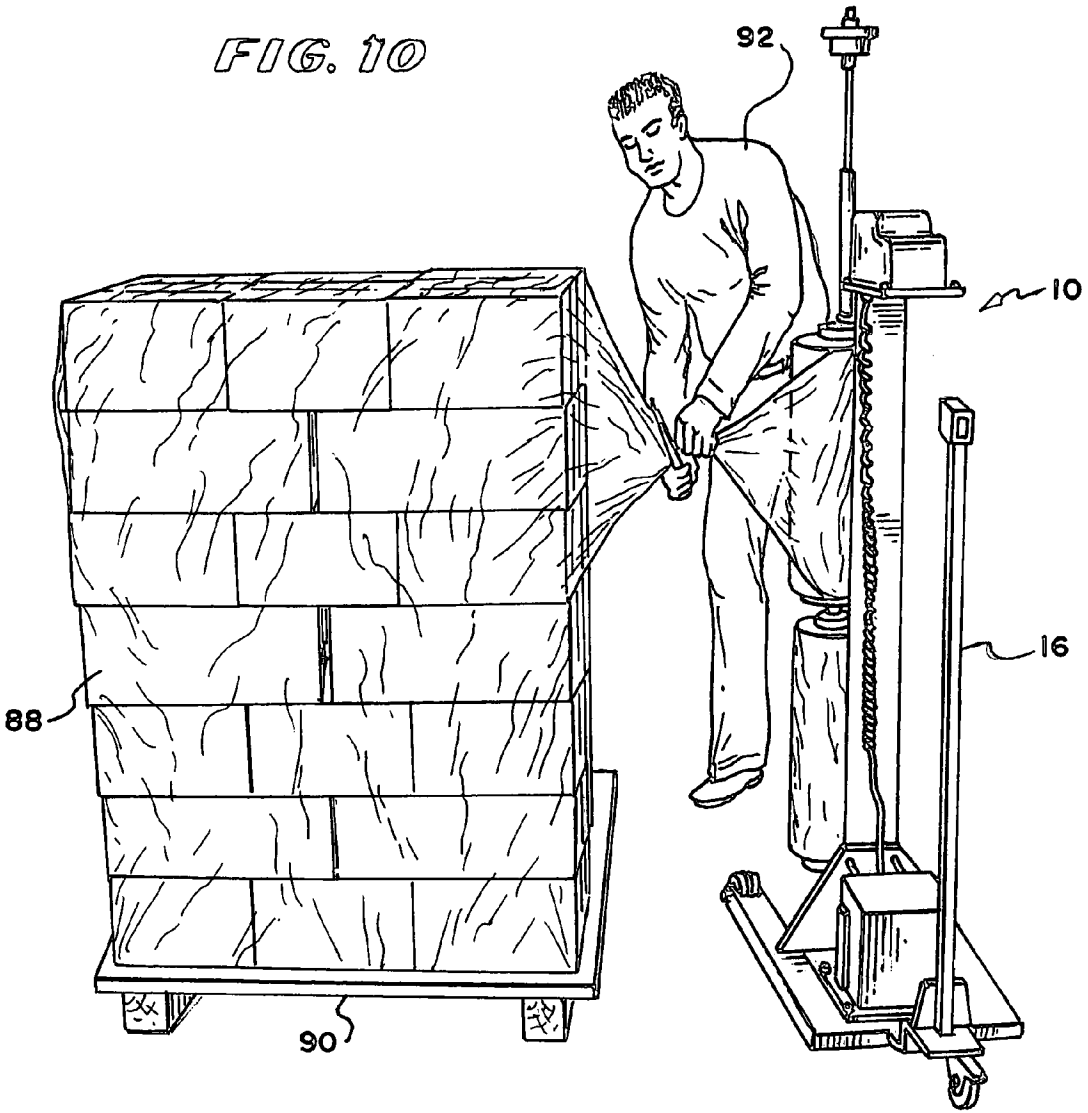
FIG. 10 is a perspective view of the use of the wrapping machine of FIG. 1 in another position.

In FIG. 10, the operator 92 is shown cutting the wrapping material between the push/pull cart vehicle 10 and the palletized objects 88 so that it may be separated from the rolls of wrapping material on the push/pull cart vehicle 10.

As can be understood from the above description, the wrapping vehicle or machine of this invention has several advantages, such as for example: (1) it is labor saving; (2) it is fast because of the ability to wrap more than one turn of wrapping material in one revolution about the objects being wrapped; (3) it permits easy positioning of the wrapping material in elevation; and (4) it permits effective adjustment of tension on the rolls of wrapping material.

While a preferred embodiment of the invention has been described with some particularity, many modifications and variations of the invention are possible within the light of the above teachings, and therefore, it is to be understood that the invention may be practiced other than as specifically described but within the scope of the appended claims.

What is claimed is:

1. A method of wrapping a group of objects comprising the steps of:

selecting a number of rolls and widths of wrapping material for wrapping the group of objects;

mounting each of the selected number of rolls of wrapping material on a corresponding one of vertically-movable ball-nut driven cantilevers, whereby each roll of wrapping material may have its width and tension individually adjusted;

moving the selected number of rolls of wrapping material as a group to a selected vertical height;

fastening one end of each of the selected number of rolls of wrapping material onto at least one object of the group of objects; and moving the selected number of rolls of wrapping material and the group of objects with respect to each other, whereby the group of objects are wrapped simultaneously with the wrapping material from the selected number of rolls of wrapping material.

2. A method in accordance with claim 1 further including the step of replacing at least one roll of wrapping material when empty without moving the other rolls of wrapping material.

3. A method in accordance with claim 1 further including the step of adjusting tension in one roll of wrapping material without adjusting tension in the other rolls of wrapping material.

4. A method in accordance with claim 1 in which the step of moving the selected number of rolls of wrapping material and group of objects with respect to each other comprises the step of moving the group of objects to pull the wrapping material from the selected number of rolls of wrapping material while the selected number of rolls of wrapping material remains in one location and the group of objects rotates.

5. A method in accordance with claim 4 wherein the group of objects is mounted on a rotatable turntable.

6. A method in accordance with claim 1 wherein the step of moving the selected number of rolls of wrapping material and the group of objects with respect to each other includes the step of moving the selected number of rolls of wrapping material around the group of objects.

7. A method in accordance with claim 6 wherein the multiple rolls of wrapping material are mounted on a vehicle; the vehicle includes a drive mechanism for changing the elevation of the multiple rolls of wrapping material by rotating a drive screw to move ball nuts.

8. A method in accordance with claim 7 wherein the vehicle is a push/pull cart that includes a handle on one end and rolls of wrapping material on the other end whereby an operator can push the cart and rolls of wrapping material.

9. A method in accordance with claim 8 wherein the handle includes an electrical switch operable to actuate vertical movement of the drive mechanism.

10. A method in accordance with claim 7 wherein the vehicle is a push/pull cart that includes a handle on one end whereby an operator can pull the cart.

11. A method in accordance with claim 7 wherein the vehicle includes a motor for driving wheels of the vehicle.

* * * * *